US005989616A

United States Patent [19]

Bouton-Hughes

[11] Patent Number: 5,989,616

[45] Date of Patent: Nov. 23, 1999

[54] WOODEN CONTAINER

[76] Inventor: Philippe Bouton-Hughes, 3, rue des Vignes, 45240 Marcilly en Villette, France

[21] Appl. No.: 08/983,301

[22] PCT Filed: Jun. 7, 1996

[86] PCT No.: PCT/FR96/00870

§ 371 Date: Apr. 24, 1998

§ 102(e) Date: Apr. 24, 1998

[87] PCT Pub. No.: WO97/02990

PCT Pub. Date: Jan. 30, 1997

[30] Foreign Application Priority Data

Jul. 7, 1995 [FR] France ..... 95 08266

[51] Int. Cl.[6] ..... B65D 8/00; A21D 8/00

[52] U.S. Cl. ..... 426/496; 426/113; 426/115; 426/128; 426/392; 426/394; 426/505; 426/523; 217/122; 249/117; 249/134; 249/DIG. 1; 99/426

[58] Field of Search ..... 426/106, 107, 426/108, 112, 113, 114, 115, 119, 128, 132, 135, 392, 394, 496, 505, 523; 229/182.1, 192, 198; 217/122, 123, 125, 3 FC; 249/117, 134, DIG. 1; 99/426

[56] References Cited

U.S. PATENT DOCUMENTS

| | | | |
|---|---|---|---|
| 78,110 | 5/1868 | MacDaniel | 217/122 |
| 527,761 | 10/1894 | Asam et al. | 217/122 |
| 821,010 | 5/1906 | Wilcox | 217/122 |
| 821,074 | 5/1906 | Wilcox | 217/122 |
| 1,261,982 | 4/1918 | Walker | 217/122 |
| 1,272,324 | 7/1918 | Walker | 217/122 |
| 1,906,324 | 5/1933 | Madison et al. | 217/122 |

FOREIGN PATENT DOCUMENTS

| | | |
|---|---|---|
| 2 240 633 | 3/1975 | France . |
| 2 464 205 | 3/1981 | France . |
| 2700314 | 7/1994 | France . |
| 3421 360 | 12/1985 | Germany . |
| 3812188 | 10/1989 | Germany . |
| U-91 15 842 | 2/1992 | Germany . |
| U-94 17 522 | 12/1994 | Germany . |
| 707453 | 4/1954 | United Kingdom . |
| 1 123 360 | 8/1968 | United Kingdom . |

*Primary Examiner*—Milton Cano

*Attorney, Agent, or Firm*—Hoffmann & Baron, LLP; Irving N. Feit

[57] ABSTRACT

A method for preparing a food product to be cooked or reheated in a thermal oven, wherein the food is placed in a container made of a single peeled-wood blank that is folded and assembled at the folded side walls thereof. A tray particularly suitable for use in the method is also disclosed.

20 Claims, 8 Drawing Sheets

WOODEN CONTAINER

This invention relates to the packaging of food products, in particular ready-to-cook or ready-to-heat products, and containers specially designed for such an application.

Ready-to-cook products are usually packaged in packs formed by an aluminum foil or plastic bag. With the advent of microwave ovens, plastic packs have tended to take the place of metal packs. While such packaging is without doubt suitable for cooking or heating purposes, it lends an unsatisfactory industrial aspect to the product.

A packaging for cooked meals intended to heated exclusively in a microwave oven is also known in the state of the art. This packaging was described in German patent OS3812118. It is a dish-shaped recipient, made of chipboard and covered by an internal polyethylene or polyester coating.

However, no-one has ever considered the possibility of using wood packaging for cooking in a heating oven. Such a solution runs counter to the preconceptions of specialists who logically consider that the wood is likely to catch fire due to the heat and is therefore unsuited for use as a cooking mold.

Surprisingly, it has emerged that it is possible to cook a food product packaged in a container of folded and assembled wood in a standard baker's oven. In particular, it appears that such a packaging is suitable for the cooking of dough for bread, brioches, cakes, etc., and more generally for any food product necessitating more than 30 minutes' cooking in a heating oven at temperatures exceeding 200° C. and even 250° C.

This invention aims firstly to propose a packaging process which combines a traditional appearance prior to use with the possibility of forming a cooking mold for use in a heating oven. In addition, the invention proposes a packaging process which is inexpensive and which, unlike the cold-molded wooden recipients described in the German patent mentioned above, does not require heavy investment for industrial production.

For this purpose, the invention concerns a packaging process for food products to be cooked or heated in a heating oven, the process comprising depositing the food product in a container formed by a single blank of very thinly manufactured wood (i.e., peeled wood or veneer), folded and assembled through refolded lateral walls.

Advantageously, the packaging process comprises placing the food product to be cooked or heated in a container formed by folding and assembling a blank which possesses a central part forming the bottom of the container, whether or not cut out, prolonged a two opposite ends by two sides separated from the central part by pre-grooved lines, and at the other two opposite ends by sides separated from the central part by pre-grooved lines laterally prolonged by connecting tabs separated from the sides by pre-grooved lines.

According to a first variant, the lateral walls are assembled by stapling.

According to a preferred second variant, the lateral walls are assembled by gluing, using a cyanoacrylate-type glue. This kind of glue is particularly suitable for reasons which will be explained at a later stage and by virtue of its resistance to heat, unlike other industrial adhesives such as heat-fusible glues.

According to a preferred application, the food product is placed in the container, in the state of uncooked dough, to be cooked in the heating oven.

According to a variant, a sheet of greaseproof paper or a fatty substance is inserted between the container and the food product so as to prevent the dough from sticking to the container during cooking.

The invention also aims to propose containers for use in the above-mentioned packaging process.

There are numerous variants of containers made of peeled wood known in the state of the art. The best known containers are manufactured by the interlacing of narrow strips joined together by stapling. Such containers are not very attractive and are suitable for routine transport and storage purposes. The main advantage of this kind of container lies in its low cost price.

With a view to a more attractive presentation, containers made by cutting a sheet of peeled wood and by stapling the side walls have also been proposed.

For the specialist, stapling represents virtually the only assembly solution conducive to the requirements of mass production. These requirements involve working with wood coming directly from the peeling plant since it is not economically viable to dry the wood prior to use.

There are, however, several drawbacks to the adoption of stapling with containers to be used with food. Firstly, staples are not inert and are subject to rust, thus denaturing the food in the container. Secondly, staples which are poorly inserted or which become detached for whatever reason can be added to food product in the container and thus create a serious danger to health in the event of ingestion.

Although French patent FR2240633 proposes a container manufactured by spreading glue on the lateral overlaps as a means of joining them together, the use of glue raises numerous problems in the context of the industrial production of containers characterized by short manufacturing times. Indeed, the glues typically used for sticking wood together require prolonged pressure (about 24 hours) to the assembled sides before adequate grip is obtained.

The use of hot-melt glue is also known, the application of which requires expensive techniques and complex gluing appliances which in turn necessitate constant maintenance and can only be used on dry wood.

Thus a specialist interested in using glue as a solution to the assembly problem would come up against major difficulties in terms of the industrial application of such a solution.

There are no documents in the prior art to suggest the use of single-component glues. On the contrary, the specialist's experience of the prior art would lead him to discount such an application on peeled wood which had not been dried beforehand.

For example, German patent DE3421360, in describing a process for the gluing of porous or absorbent surfaces, points out that such a cyanoacrylate glue is ill-suited to this kind of surface without previous treatment. This document states that the glue must be "lathered up" before it can be used.

Another document, English patent GB1123360, states that the traces of humidity are liable to reduce the stability or efficiency of the adhesive material. In short, so far from suggesting the use of cyanoacrylate for the assembly of non-dried peeled wood, the state of the art actually contains indications warning the specialist against such use.

The invention aims to remedy the shortcomings of stapled containers by proposing a container which can be mass produced without presenting the risks associated with containers of the prior art.

To this end, the container according to the invention is comprised of a blank of non-dried peeled wood possessing a central part and by lateral; prolongations assembled through the gluing of the said lateral prolongations with a glue of cyanoacrylate type.

Preferably, the lateral prolongations are glued together by means of an ethyl cyanoacrylate mono-component adhesive. Surprisingly, such adhesives set very quickly when used with non-dried peeled woods. The relative humidity of the non-dried peeled wood typically lies between 20 and 50%.

Advantageously, the blank presents a central part forming the bottom of the container, whether or not cut separately, prolonged at two opposite ends by two sides separated from the central part by pre-grooved lines, and at the other two opposite ends by sides separated from the central part by pre-grooved lines laterally prolonged by connecting tabs separated from the sides by pre-grooved lines.

According to an advantageous embodiment, the width of the base of the sides prolonging the lower part is slightly less than the dimension of the central part measure in the same direction so that the assembled container possesses hollowed-out corners.

This embodiment allows the product held in the container to expand, which may be useful in the case of products such as brioche dough. Once filled with dough, the container may be placed directly in the oven. The dough will then expand to form "ears" overlapping by the openings at the four corners.

According to another embodiment, at least two opposite sides are of approximately trapezoid shape, with the result that the assembled container is approximately in the shape of a flattened cone, thereby facilitating the stacking of empty containers.

According to another variant, two opposite sides possess holes for housing additional pins laterally prolonging a transverse partition parallel to the bottom in order to form a cover, or perpendicular to the bottom in order to form a separation.

The invention also relates to a process for manufacturing a container, in particular for food products, by the folding of a blank presenting a central part, and by lateral prolongations, formed in a strip of peeled wood, preferably of poplar wood, and by joining up of the lateral prolongations, characterized in that the join between two lateral prolongations is formed by applying an ethyl cyanoacrylate mono-component adhesive on the non-dried peeled wood, and by a pressure applied on the glued surfaces lasting less than 10 seconds. Preferably, the pressure exerted on the glued surfaces is in excess of 20 kilograms.

Surprisingly, the performance of such adhesives, which are reputed to necessitate careful preparation of the surfaces to which they are to be applied, is improved when they are applied on non-dried and non-prepared peeled wood. This improved performance is expressed in particular by much faster adhesion, appreciably faster than on dried products.

Advantageously, the ethyl cyanoacrylate mono-component adhesive is applied on several areas of the blank in a flat position using a distributor head, and normal pressure is exerted on the glued areas immediately afterwards using a shaping mold.

Preferably, the ethyl cyanoacrylate mono-component adhesive is applied on the non-dried peeled wood and a pressure of over 20 kilograms is exerted normally on the glued areas for the period lasting between 2 and 5 seconds.

The invention also concerns a process for packaging a ready-to-cook or ready-to-heat food product, characterized in that it is prepared in a container conforming to the invention.

According to a particular application of the invention, the container is partially covered with a ready-to-cook dough.

A clearer understanding of the invention will emerge from the description of a non-limitative embodiment, to be read in conjunction with the accompanying drawings in which.

Figure 1:
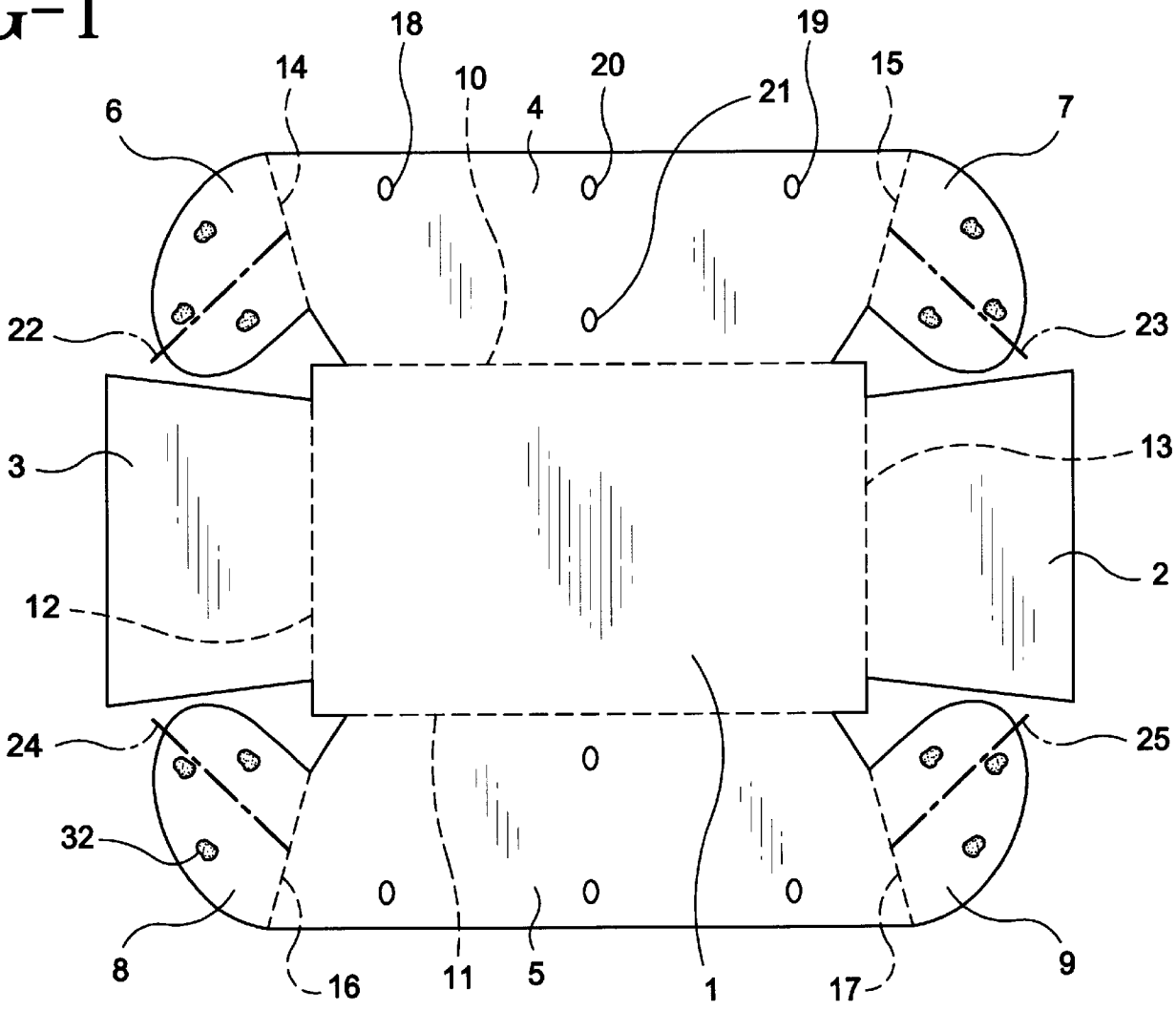
FIG. 1 represents a front view of the blank.

FIG. 1 represents a front view of a non-limitative example of a blank from the manufacture of a container according to the invention. It is cut in a strip of very thinly manufactured poplar wood supplied from a peeling unit (i.e., peeled wood). The cutting operation is carried out using, for example, a die. This die comprises cutting areas and non-cutting areas designed to form the pre-grooved lines which will then constitute mobile joints.

The blank presents a central part (1) forming the bottom of the container. This central part (1) may be solid or serrated so as to allow, for example, the flow of juices or liquids. This central part (1) is prolonged on two opposite edges by symmetrical sides (2, 3) and on two other opposite edges by two other sides (4, 5).

The two sides (2, 3) constitute the small sides of the assembled container. They are approximately trapezoid in shape, with a base which is a little narrower than the central part (1). Pre-grooved lines (12, 13) facilitate the folding of these faces (2, 3) in relation to the central part (1).

The other two sides (4, 5) constitute the large sides of the assembled container. They are approximately trapezoid in shape, with a base which is a little shorter than the length of the central part (1). The trapezoid zone is prolonged by ear-shaped tabs (6, 7, 8, 9). They are approximately symmetrical in relation to a median line (22, 23, 24, 25) which, once the container is assembled, will be parallel to the lower edge of the side (2, 3) and the pre-grooved line (12, 13).

Pre-grooved lines (10, 11) facilitate the folding of these faces (4, 5) in relation to the central part (1). Similarly, pre-grooved lines (14 to 17) facilitate the folding of the tabs (6 to 9).

Figure 3:
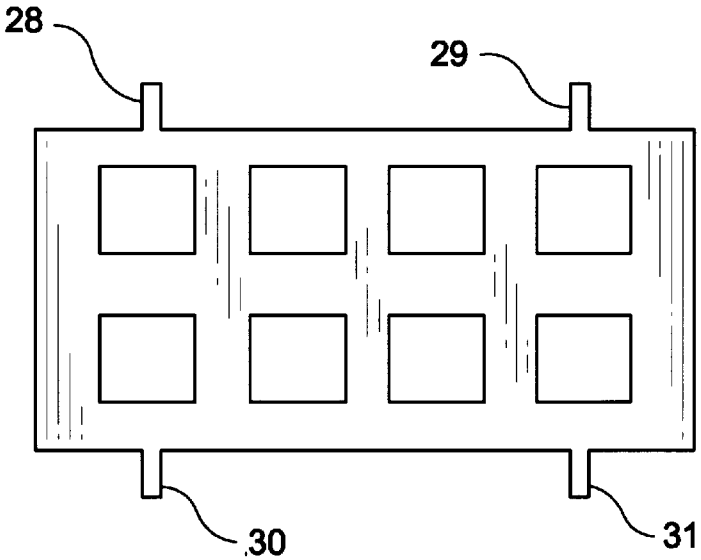
FIGS. 2 and 3 represent, in reduced scale, front views of the blank forming respectively a transverse partition and a cover.
Figure 2:
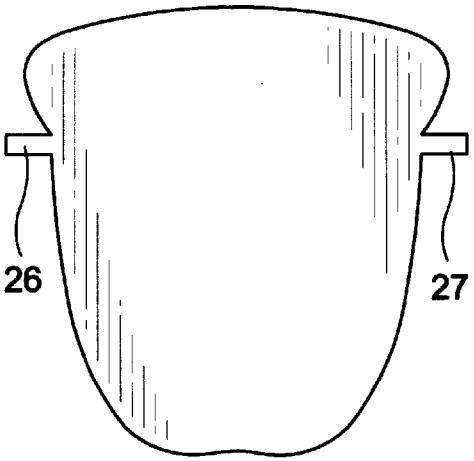

The sides (4, 5) also possess holes. These holes (18, 19, 20) are designed to house lugs prolonging a cover, or (holes 20, 21) lugs prolonging a separation partition. FIGS. 2 and 3 are reduced scale representations of front views of the blank forming respectively a transverse partition and a lid. They are cut from a sheet of peeled wood or from another elastically moldable material, and possess pins (26 to 31) which can be housed in the holes (18 to 21). Thanks to the cooperation between the pins and the holes, the stiffness of the material holds the partition or the cover in transverse position.

Figure 4:
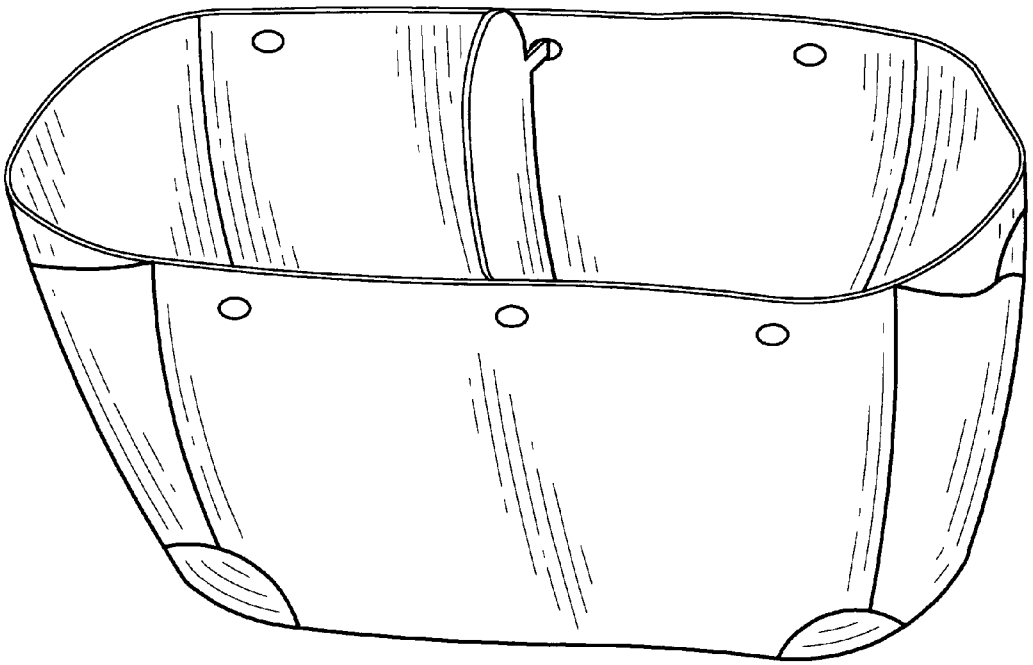
FIG. 4 represents a perspective view of an embodiment of a container according to the invention.

FIG. 4 represents the container in perspective view.

Adhesive points (32) are placed on the inner surface of the lateral tabs (6 to 9) visible in FIG. 1.

As soon as the adhesive has been deposited, the blank is placed in a molding press comprising a die whose section approximately corresponds to the surface of the central part (1) and a counter-die for folding the sides (2 to 5) and turning down the lateral tabs (6 to 9). The lateral tabs (6, 7) of the side (4) are refolded on the sides (2, 3) and the lateral tabs (8, 9) of the face (5) are then folded back on the first tabs (6, 7).

Figure 5:
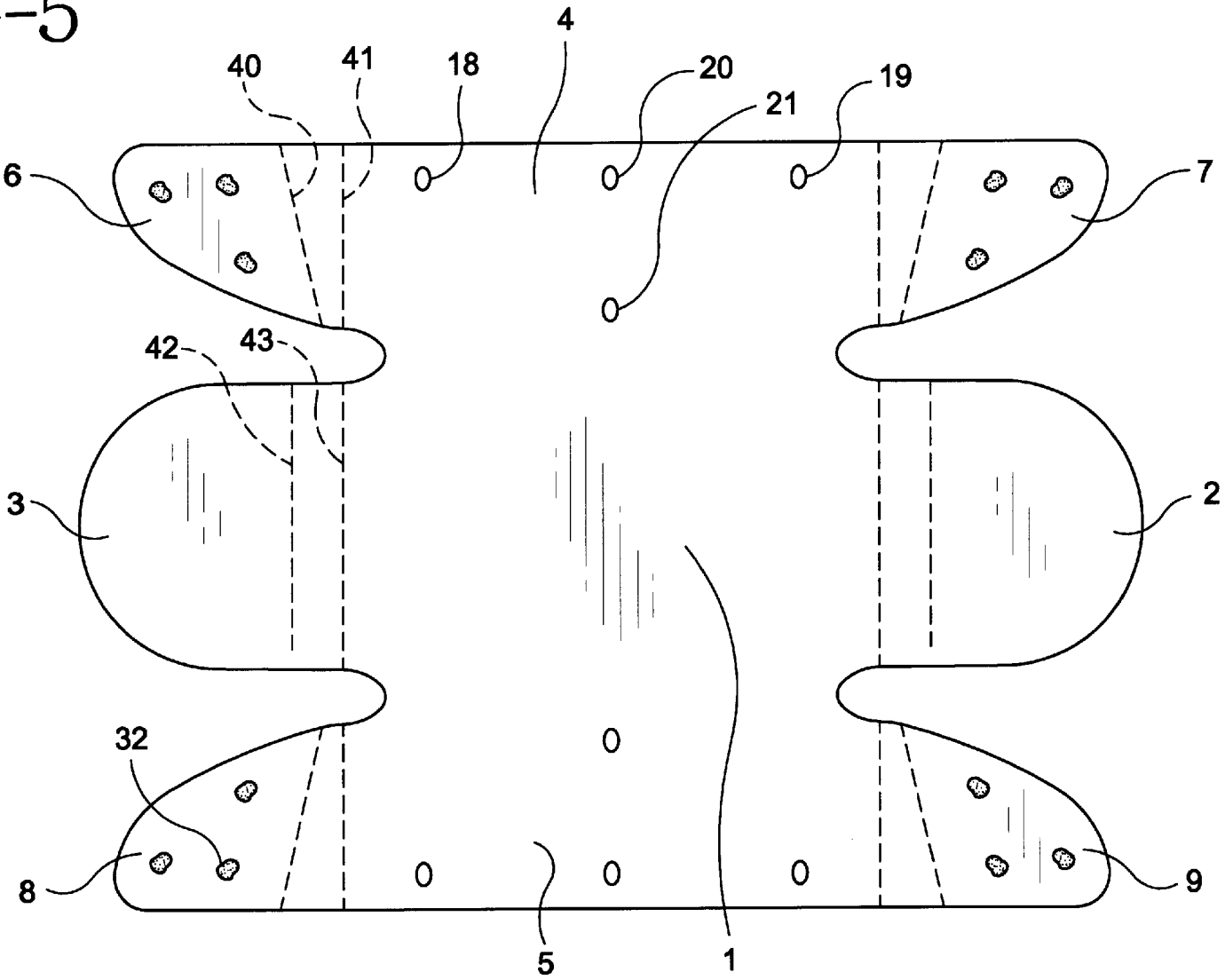
FIG. 5 represents a front view of a variant of the blank.

FIG. 5 represents a front view of a variant of a blank differing principally from the blank represented in FIG. 1 in the position of its pre-grooved lines.

The lateral sides (4, 5) are not demarcated in relation to the central part by pre-grooved lines. Thus, the container will possess curved surfaces during assembly. The lateral tabs (6 to 9) are separated from the lateral sides (4, 5) by a pair of pre-grooved lines (40, 41) in order to facilitate folding and to allow curved lines of relatively low radius of curvature to be formed.

Similarly, the faces (2, 3) are separated from the central part (1) by two approximately parallel pre-grooved lines (42, 43).

Figure 6:
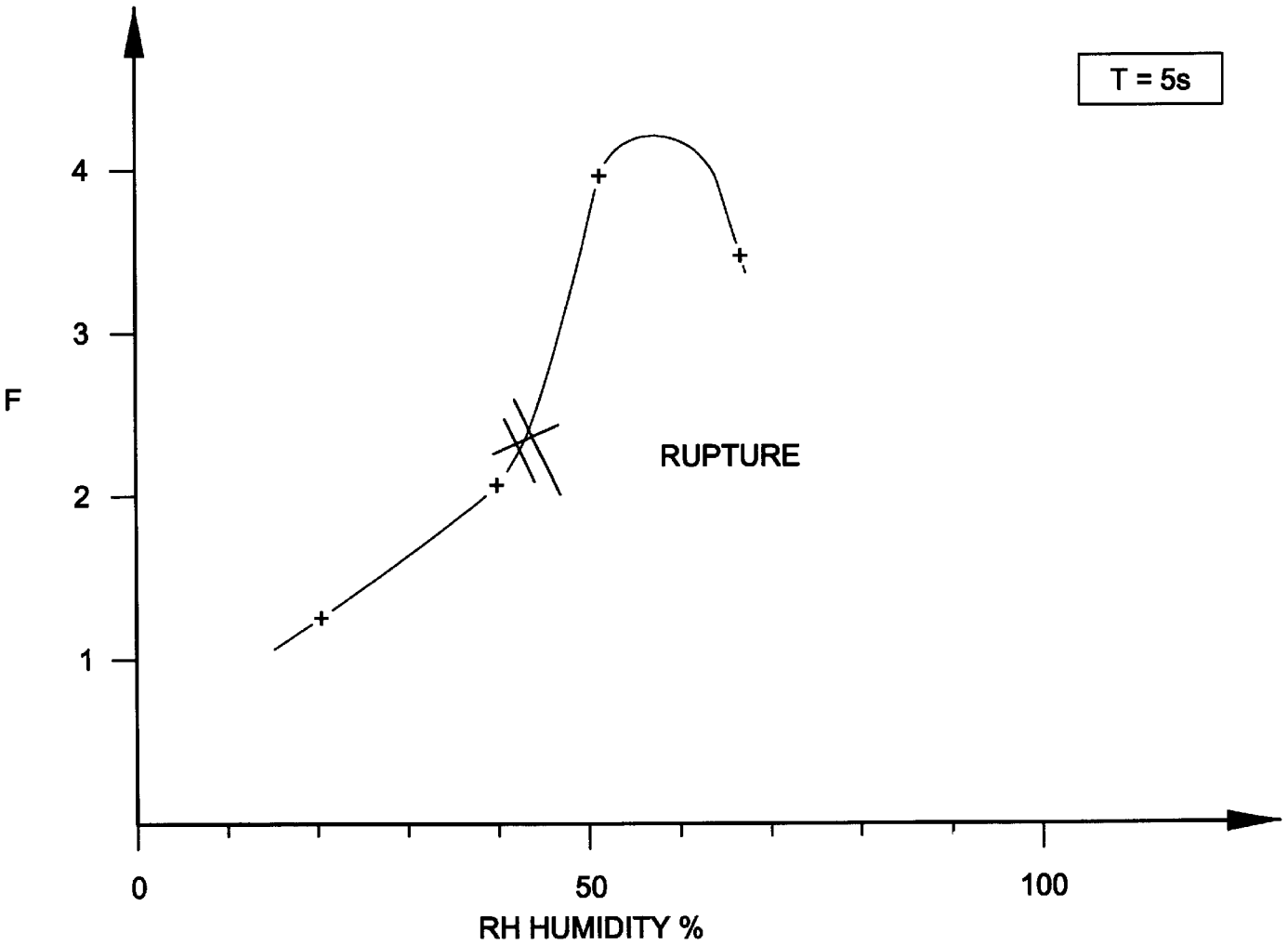
FIG. 6 represents an example of the performance curve of the adhesive in function of the humidity of the material.

FIG. 6 represents an example of the performance curve of the adhesive in function of the humidity of the material; measured with a humidity controller whose reading range lies between 4% and 60% of relative humidity, with an accuracy of 0.5%. The experiment was conducted on test pieces of peeled poplar wood presenting different degrees of humidity. The humidity level was adjusted by means of partial drying or, on the contrary, by re-humidifying of the test pieces. Two 10 $cm^2$ strips were glued together using an ethyl cyanoacrylate adhesive. A drop was deposited on one of the strips, using a pipette with an outlet section of 1 mm, and a pressure of 10 kg was applied perpendicularly to the surfaces of the strips for a fixed time of 5 seconds.

The strips were then submitted to traction in a direction perpendicular to the gluing zone, the traction force being increased until the two strips were separated. The traction force exerted at the moment of rupture was recorded so that the line of the curve reproduced in diagram form in FIG. 6 could be drawn. It should be noted that, in certain conditions of residual humidity and bonding time, the adhesive's resistance to shearing is far greater than the test pieces' resistance to traction. In this case, the test piece is destroyed before separation of the test piece.

The shearing resistance curve in function of the relative humidity of the material, determined in the aforementioned way, presents a maximum value corresponding approximately to the state of a fresh sheet of wood which has just been peeled.

Figure 7:
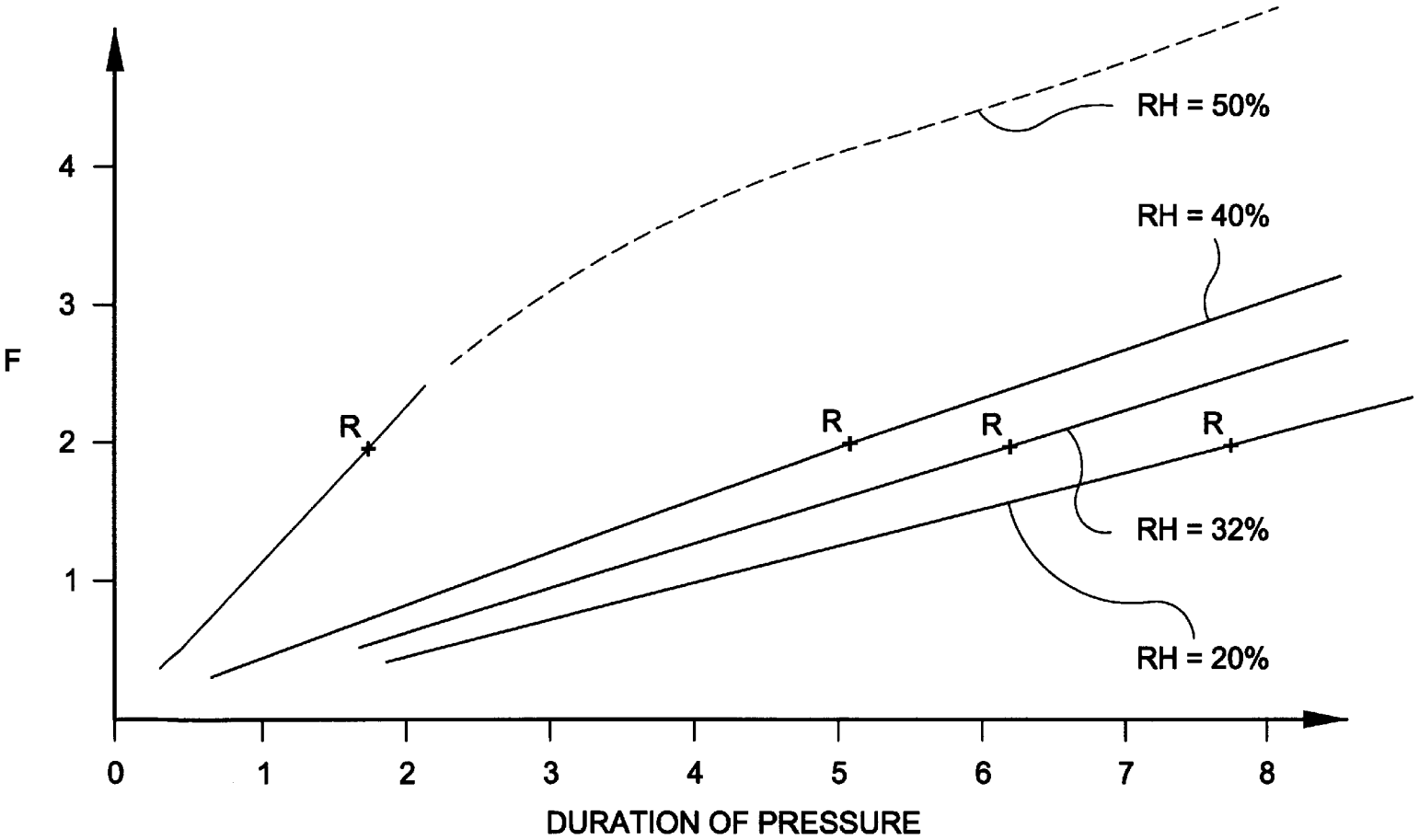
FIG. 7 represents an example of the performance curve of the adhesive in function of the duration of gluing and of the relative humidity of the material.

FIG. 7 represents an example of a series of adhesive performance curves in function of gluing time. The experiment was carried out with test pieces of peeled poplar wood presenting degrees of humidity.

Constant pressure was applied on the test piece, just after bonding, over different periods of time. It was observed that, in the case of degrees of humidity corresponding to newly peeled fresh wood, for example poplar wood, the period of pressure could be reduced without adversely effecting the resistance of the glue.

Figure 8:
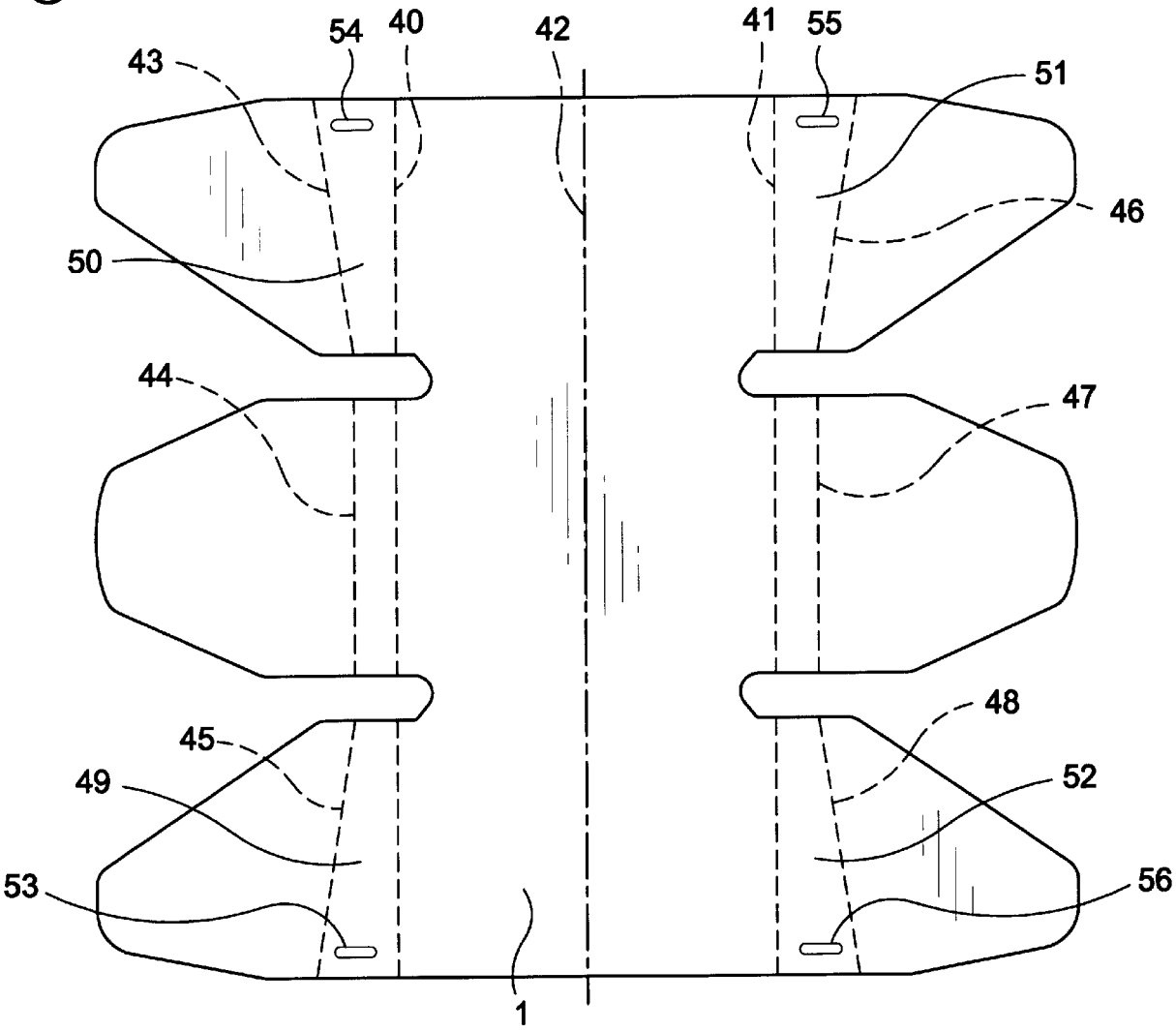
FIG. 8 represents a front view of another variant of the blank.

FIG. 8 represents a view of the blank for manufacturing a variant of a container. The blank possesses two pre-grooved lines (40, 41) parallel to the median axis (42) and stretching over the three lateral sides of the blank. The two other perpendicular edges of the central part (1) are not demarcated by any pre-grooved line.

Two other pre-grooved lines are divided into three segments. The central segment (44, 47) is parallel to the median axis (42). The end segments (43, 45, 46, 48) diverge and form an angle of about 10° in relation to the median axis (42). The surfaces (48, 49, 50, 51) lying between the pre-grooved lines form lateral panels which give the container a polygonal form. These surfaces present, near their outer edge, oblong cuts (52 to 56) whose principal axis is oriented perpendicularly to the median axis (42).

Figure 9:
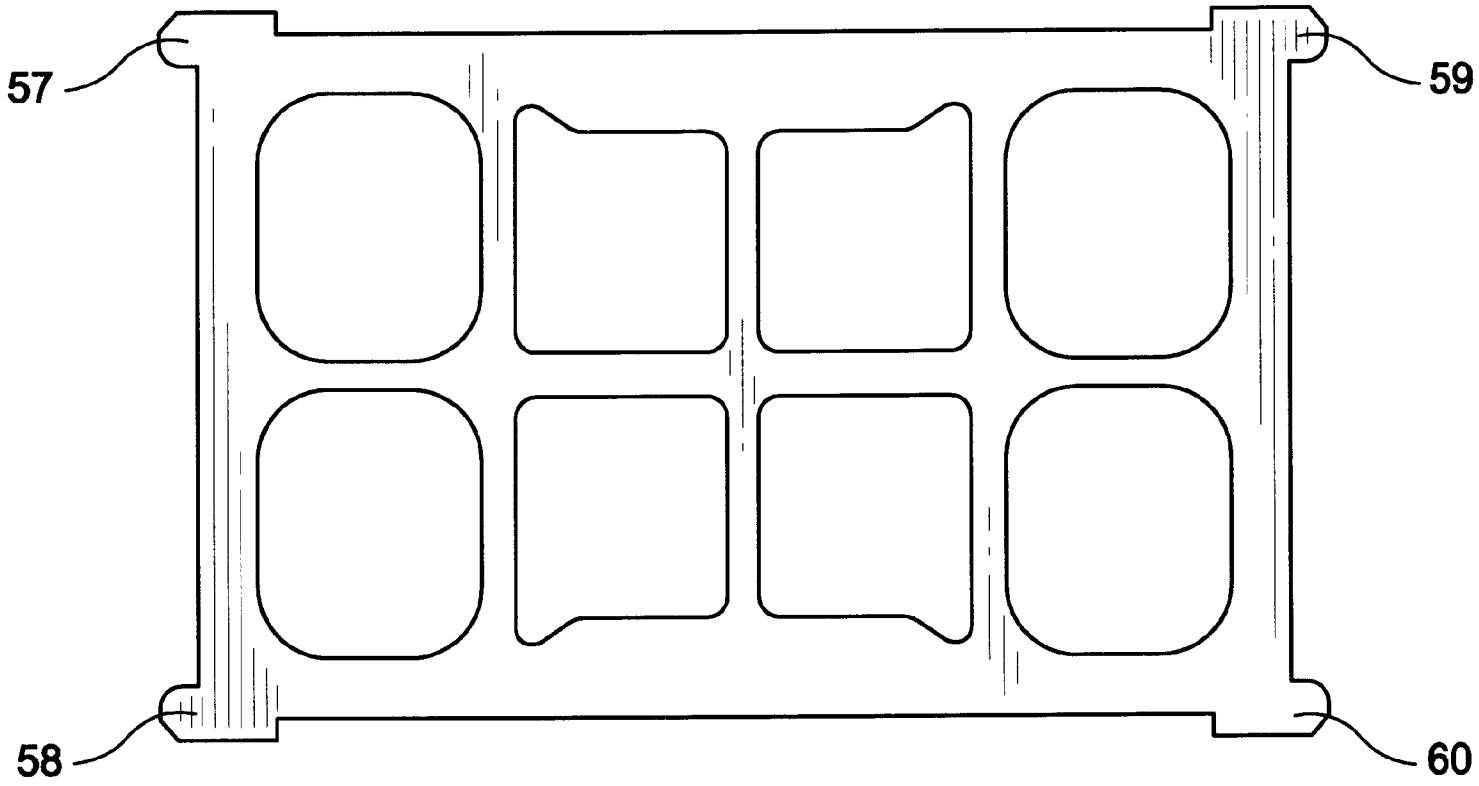
FIG. 9 represents a front view of a variant of the cover.

These cuts are designed to house ears (57 to 60) at each of the angles of the cover, as illustrated in FIG. 9. These ears extend beyond the lateral edges of the cover so as to form bulging protuberances. The cross-section of these ears (57, 60) is approximately equal to the length of the principal axis of the oblong cuts (52 to 56). The cover may be placed on the container by elastic molding. The ears are then housed in the cuts. When the cover returns to its initial position, it is locked onto the container by the ears. The cover may nonetheless be removed by deforming it elastically.

The preceding description of the invention is given as a non-limitative example. The specialist may produce different variants while remaining within the scope of the invention.

I claim:

1. A process for preparing food products to be cooked or heated in an oven comprising the steps of:

depositing a food product in a container formed by folding and assembling a single blank of peeled wood;

placing said container in an oven for cooking or heating said food product.

2. The process as defined in claim 1, wherein said container includes a central part forming the bottom of said container and four lateral side walls separated from the central part by pre-grooved lines for folding and assembling said single blank of peeled wood to form said container.

3. The process as defined in claim 2, wherein at least one of said lateral side walls includes a connecting tab separated from said side wall by a pre-grooved line for folding said connecting tab, said connecting tab being assembled to an adjacent lateral side wall to form said container.

4. The process as defined in claim 1, wherein said container is assembled by stapling.

5. The process as defined in claim 1, wherein said container is assembled by gluing with a cyanoacrylate glue.

6. The process as defined in claim 1, wherein said food product is deposited in said container in an uncooked state for cooking in said oven.

7. The process as defined in claim 1, wherein said food product is uncooked dough.

8. A container comprising:

a blank of non-dried peeled wood folded and assembled to form said container, wherein said container contains uncooked dough for cooking or heating in an oven.

9. The container as defined in claim 8 wherein said container includes a central part forming the bottom of said container and four lateral side walls separated from the central part by pre-grooved lines for folding and assembling said single blank of peeled wood to form said container.

10. The container as defined in claim 9, wherein said lateral side walls are assembled by stapling.

11. The container as defined in claim 9, wherein said lateral side walls are assembled by gluing with a cyanoacrylate glue.

12. The container as defined in claim 9, wherein the width of the base of said lateral side walls adjacent said central part is less than the dimension of the central part measured in the same direction so that the assembled container is formed with hollowed-out corners.

13. The container as defined in claim 9, wherein at least two opposite lateral side walls are substantially trapezoid in shape such that the assembled container is approximately in the shape of a flattened cone, thereby facilitating the stacking of empty containers.

14. The container as defined in claim 9, further comprising a transverse partition disposed parallel to said bottom of said central part to form a cover for said container or disposed perpendicular to said bottom of said central part to form a separation within said container.

15. The container as defined in claim 9, wherein at least one of said lateral side walls includes a connecting tab separated from said side wall by a pre-grooved line for folding said connecting tab, said connecting tab being assembled to an adjacent lateral side wall to form said container.

16. The container as defined in claim 15, wherein said connecting tab is assembled to said adjacent lateral side wall by stapling.

17. The container as defined in claim 15, wherein said connecting tab is assembled to said adjacent lateral side wall by gluing with a cyanoacrylate glue.

18. The container as defined in claim 8, wherein said container is assembled by stapling.

19. The container as defined in claim 8, wherein said container is assembled by gluing with a cyanoacrylate glue.

20. The container as defined in claim 8, wherein said single blank of peeled wood includes one or more serrations formed therethrough.

* * * * *